US008223077B2

(12) United States Patent
Chiang et al.

(10) Patent No.: US 8,223,077 B2
(45) Date of Patent: Jul. 17, 2012

(54) MULTISECTOR PARALLEL PLATE ANTENNA FOR ELECTRONIC DEVICES

(75) Inventors: Bing Chiang, Cupertino, CA (US); Gregory A. Springer, Sunnyvale, CA (US); Douglas B. Kough, San Jose, CA (US)

(73) Assignee: Apple Inc., Cupertino, CA (US)

( * ) Notice: Subject to any disclaimer, the term of this patent is extended or adjusted under 35 U.S.C. 154(b) by 564 days.

(21) Appl. No.: 12/401,601

(22) Filed: Mar. 10, 2009

(65) Prior Publication Data

US 2010/0231476 A1 Sep. 16, 2010

(51) Int. Cl.
*H01Q 1/24* (2006.01)
*H01Q 13/00* (2006.01)

(52) U.S. Cl. ..... 343/702; 343/780; 343/772

(58) Field of Classification Search ..... 343/772, 343/786, 780, 776, 784, 783, 702
See application file for complete search history.

(56) References Cited

U.S. PATENT DOCUMENTS 5,006,859 A * 4/1991 Wong et al. ..... 343/700 MS
5,406,292 A * 4/1995 Schnetzer et al. ..... 343/700 MS
6,127,987 A 10/2000 Maruyama et al.
6,646,605 B2 11/2003 McKinzie et al.
6,831,607 B2 12/2004 Hebron et al.
6,831,608 B2 * 12/2004 Arvidsson ..... 343/700 MS
6,930,647 B2 * 8/2005 Wako et al. ..... 343/772
7,126,553 B1 10/2006 Fink et al.
7,345,634 B2 3/2008 Ozkar et al.
7,501,990 B2 * 3/2009 Stutzke ..... 343/770
2004/0075611 A1 4/2004 Kenoun et al.
2006/0001574 A1 * 1/2006 Petros ..... 343/702
2007/0120740 A1 5/2007 Iellici et al.
2007/0146208 A1 * 6/2007 Lee et al. ..... 343/700 MS
2007/0216594 A1 9/2007 Uno et al.
2007/0252774 A1 * 11/2007 Qi et al. ..... 343/866
2008/0309561 A1 * 12/2008 Lee et al. ..... 343/700 MS
2010/0156741 A1 * 6/2010 Vazquez et al. ..... 343/846

* cited by examiner

*Primary Examiner* — Hoanganh Le
(74) *Attorney, Agent, or Firm* — Treyz Law Group; G. Victor Treyz; David C. Kellogg

(57) ABSTRACT

Electronic device antennas with multiple parallel plate sectors are provided for handling multiple-input-multiple-output wireless communications. Each antenna sector in a multisector parallel plate antenna may have upper and lower parallel plates with curved outer edges and a straight inner edge. A vertical rear wall may be used to connect the upper and lower parallel plates in each antenna sector along the straight inner edge. Each antenna sector may have an antenna probe. The antenna probe may be formed from a monopole antenna loaded with a planar patch. The planar loading patch may be provided in the form of a conductive disk that is connected to the end of a conductive antenna feed member. The conductive member may be coupled to the center conductor of a transmission line that is used to convey radio-frequency signals between the antenna probe and radio-frequency transceiver circuitry. The antenna sectors may have interplate dielectric structures.

18 Claims, 11 Drawing Sheets

MULTISECTOR PARALLEL PLATE ANTENNA FOR ELECTRONIC DEVICES

BACKGROUND

This invention relates to electronic devices and, more particularly, to antennas for electronic devices.

Portable computers and other electronic devices often use wireless communications circuitry. For example, wireless communications circuitry may be used to communicate with local area networks and remote base stations.

Wireless computer communications systems use antennas. It can be difficult to design antennas that perform satisfactorily in electronic devices. For example, it can be difficult to produce an antenna that performs well in noisy environments.

To enhance reliability and performance in a variety of wireless environments, some electronic devices use antenna diversity schemes. In some diversity schemes, an electronic device is provided with multiple redundant antennas each of which is located in a different portion of the device. These antennas may operate in similar radio-frequency bands and may be coupled to radio-frequency transceiver circuitry that monitors the quality of the signals that are received from the antennas in real time. If an antenna's performance drops below a given threshold, another antenna may be used for wireless communications activities. Antenna schemes of this type may offer superior performance to arrangements that rely solely on a single antenna. However, it is not always desirable to provide an electronic device with multiple antennas located in different portions of the device, as this adds wiring layout complexity and consumes valuable space within the device.

It would be desirable to be able to provide improved antenna arrangements suitable for enhancing wireless performance for an electronic device.

SUMMARY

Electronic device antennas are provided that have multiple antenna sectors for supporting wireless communications protocols such as multiple-input-multiple-output protocols.

An electronic device may have storage and processing circuitry. The storage and processing circuitry may handle data signals. Wireless communications circuitry may be coupled to the storage and processing circuitry and may be used in transmitting and receiving the antenna signals. The wireless communications circuitry may include radio-frequency transceiver circuitry and a multisector antenna. The storage and processing circuitry and the wireless communications circuitry may be configured to implement wireless communications protocols that make use of multiple antennas such as multiple-input-multiple-output communications protocols. During operation of the electronic device, a multiple-input-multiple-output protocol can use each of multiple individual antenna sectors in the multisector antenna to improve wireless performance. Wireless throughput, range, and reliability can be enhanced in this way.

Each antenna sector in the multisector antenna may have a pair of parallel plates. The outer edges of the parallel plates may be curved and the inner edges of the parallel plates may be straight. For example, in a dual-sector antenna, each of the parallel plates may have a curved outer edge and a straight inner edge that forms a half circle. In a four-sector antenna, each of the parallel plates may have the shape of a quarter of a disk. The plates may be placed close to each other, so that the gain pattern of the antenna spreads significantly in the vertical dimension (perpendicular to the plates). For example, in a dual sector arrangement, each of the two antenna sectors may be configured to exhibit a complementary hemispherical gain pattern.

Each antenna sector may have an antenna probe that serves as an antenna feed. The antenna probe may have a radio-frequency connector that is connected to a transmission line such as a coaxial cable that has a center conductor. The transmission line may be coupled between the antenna probe and radio-frequency transceiver circuitry. The antenna probe may have a conductive monopole antenna member that protrudes into the cavity formed by the parallel plates in the antenna sector. One end of the conductive member may be connected to the center conductor in the coaxial cable. The other end of the conductive member in the antenna probe may be connected to a loading patch. The loading patch may be formed from a conductive planar member such as a conductive disk. The plane of the loading patch may be oriented parallel to the upper and lower plates.

Each antenna sector may have interplate structures such as dielectric support posts. Different antenna sectors may have different corresponding patterns of posts, which helps to reduce symmetry between the antenna sectors and thereby improve performance in reflective environments.

Further features of the invention, its nature and various advantages will be more apparent from the accompanying drawings and the following detailed description of the preferred embodiments.

DETAILED DESCRIPTION

The present invention relates to antenna structures for electronic devices. Antennas may be used to convey wireless signals for suitable communications links. For example, an electronic device antenna may be used to handle communications for a short-range link such as an IEEE 802.11 link (sometimes referred to as WiFi®) or a Bluetooth® link. An electronic device antenna may also handle communications for long-range links such as cellular telephone voice and data links.

Antennas such as these may be used in various electronic devices. For example, an antenna may be used in an electronic device such as a handheld computer, a miniature or wearable device, a portable computer or other portable device, a desktop computer, a router, an access point, a backup storage device with wireless communications capabilities, a mobile telephone, a music player, a remote control, a global positioning system device, devices that combine the functions of one or more of these devices and other suitable devices, or any other electronic device.

Figure 1:
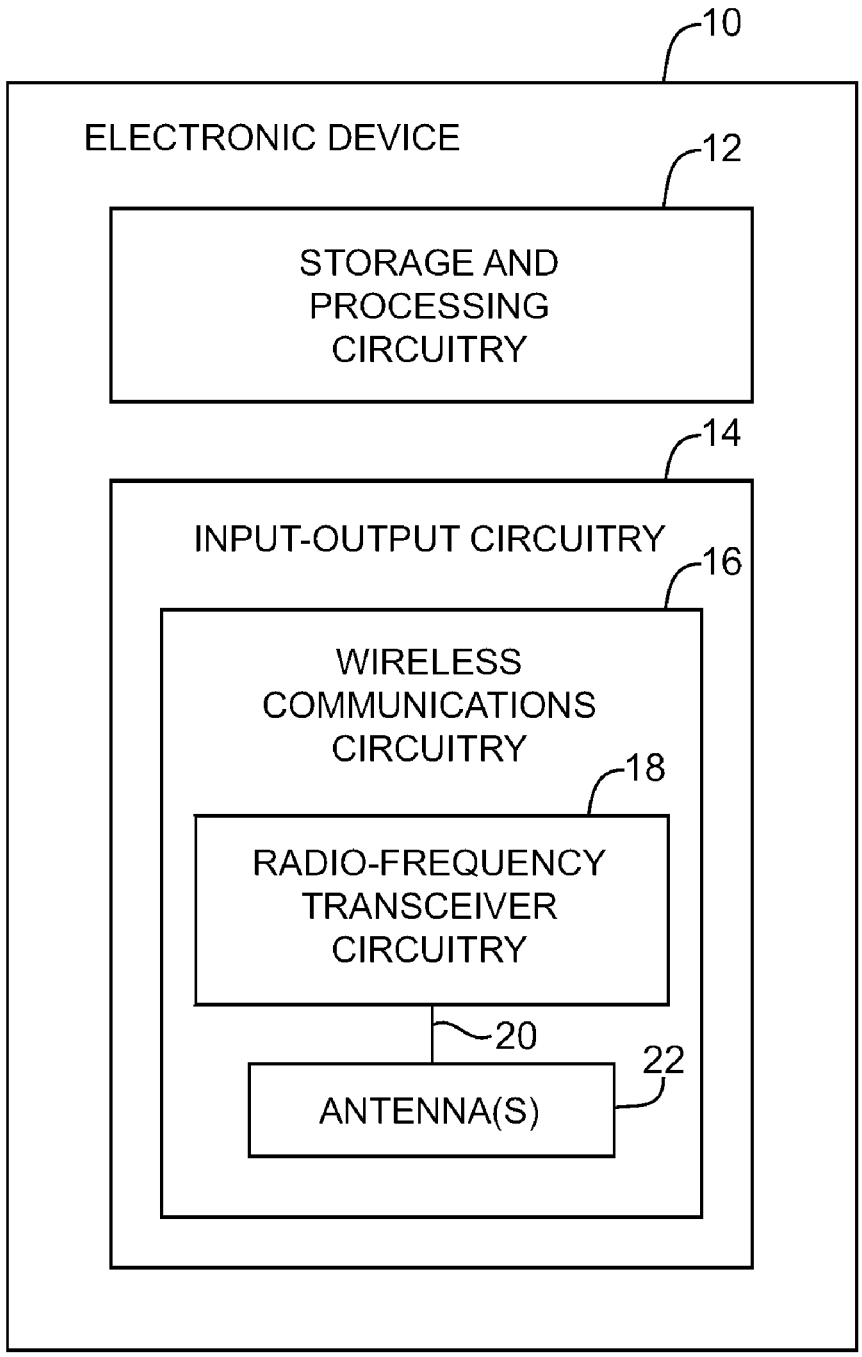
FIG. 1 is a schematic diagram of an illustrative electronic device in which an antenna may be implemented in accordance with an embodiment of the present invention.

A schematic circuit diagram of an illustrative electronic device 10 that may include one or more antennas is shown in FIG. 1. As shown in FIG. 1, device 10 may include storage and processing circuitry 12 and input-output circuitry 14. Storage and processing circuitry 12 may include hard disk drives, solid state drives, optical drives, random-access memory, nonvolatile memory and other suitable storage. Storage may be implemented using separate integrated circuits and/or using memory blocks that are provided as part of processors or other integrated circuits.

Storage and processing circuitry 12 may include processing circuitry that is used to control the operation of device 10. The processing circuitry may be based on one or more circuits such as a microprocessor, a microcontroller, a digital signal processor, an application-specific integrated circuit, and other suitable integrated circuits. Storage and processing circuitry 12 may be used to run software on device 10 such as operating system software, code for applications, or other suitable software. To support wireless operations, storage and processing circuitry 12 may include software for implementing wireless communications protocols such as wireless local area network protocols (e.g., IEEE 802.11 protocols—sometimes referred to as Wi-Fi®), protocols for other short-range wireless communications links such as the Bluetooth® protocol, protocols for handling 3 G communications services (e.g., using wide band code division multiple access techniques), 2G cellular telephone communications protocols, WiMAX® communications protocols, communications protocols for other bands, etc. These protocols may include protocols such as multiple-input-multiple-output (MIMO) protocols that employ multiple antennas (multiple antenna sectors in a multisector antenna) to increase data throughput, wireless range, and link reliability.

Input-output devices 14 may be used to allow data to be supplied to device 10 and to allow data to be provided from device 10 to external devices. Input-output devices 14 may include user input-output devices such as buttons, display screens, touch screens, joysticks, click wheels, scrolling wheels, touch pads, key pads, keyboards, microphones, speakers, cameras, etc. A user can control the operation of device 10 by supplying commands through the user input devices. This may allow the user to adjust device settings, etc. Input-output devices 14 may also include data ports, circuitry for interfacing with audio and video signal connectors, and other input-output circuitry.

As shown in FIG. 1, input-output devices 14 may include wireless communications circuitry 16. Wireless communications circuitry 16 may include communications circuitry such as radio-frequency (RF) transceiver circuitry 18 formed from one or more integrated circuits such as a baseband processor integrated circuit and other radio-frequency transmitter and receiver circuits. Circuitry 18 may include power amplifier circuitry, transmission lines such as transmission line(s) 20, passive RF components, antennas 22, and other circuitry for handling RF wireless signals.

Electronic device 10 may include one or more antennas such as antenna 22. The antenna structures in device 10 may be used to handle any suitable communications bands of interest. For example, antennas and wireless communications circuitry in device 10 may be used to handle cellular telephone communications in one or more frequency bands and data communications in one or more communications bands. Typical data communications bands that may be handled by wireless communications circuitry 16 include the 2.4 GHz band that is sometimes used for Wi-Fi® (IEEE 802.11) and Bluetooth® communications, the 5 GHz band that is sometimes used for Wi-Fi® communications, the 1575 MHz Global Positioning System band, and 2G and 3G cellular telephone bands. These bands may be covered using single-band and multiband antennas. For example, cellular telephone communications can be handled using a multiband cellular telephone antenna. A single band antenna may be provided to handle Bluetooth® communications. Device 10 may, as an example, include a multiband antenna that handles local area network data communications at 2.4 GHz and 5 GHz (e.g., for IEEE 802.11 communications), a single band antenna that handles 2.4 GHz IEEE 802.11 communications and/or 2.4 GHz Bluetooth® communications, or a single band or multiband antenna that handles other communications frequencies of interest. These are merely examples. Any suitable antenna structures may be used by device 10 to cover communications bands of interest.

It can be challenging to reliably implement high-throughput wireless links in an electronic device. Accordingly, device 10 may use a multisector antenna design for one or more of its antennas. Arrangements in which device 10 uses a single antenna 22 having multiple antenna sectors is sometimes described herein as an example. In general, however, device 10 may have one or more antennas 22 and one or more of the antennas may have multiple parts (i.e., multiple sectors). The use of a single multisector antenna 22 in device 10 is merely illustrative.

Each sector in multisector antenna 22 may exhibit a different wireless performance characteristic (e.g., a different directionality to its gain). This allows the antenna sectors to be used to implement MIMO protocols or other communications schemes that employ multiple antennas to enhance performance. When a wireless communications technique that exploits multiple antenna sectors is used, wireless performance can be enhanced (e.g., data capacity can be increased, wireless range can be increased, and/or immunity to dropped wireless links can be improved).

To implement wireless communications using a multisector antenna, radio-frequency transceiver circuitry 18 is provided with transceiver and switching circuitry that is coupled to each of the multiple sectors in multisector antenna 22. Each antenna sector may have its own antenna feed with positive and ground antenna feed terminals and may therefore operate as a separate antenna. Coaxial cables or other transmission lines (path 20 of FIG. 1) may be used to connect circuitry 18 to each of the feeds for the different antenna sectors. Circuitry 18 may include a circuit network that performs operations such as impedance matching, signal distribution, and signal switching for the antenna. Circuitry in device 10 such as circuitry 12 and 14 may also include radio circuits and general purpose processing circuitry that is configured to process the signals from multiple antenna sectors for implementing communications protocols such as MIMO protocols. The communications scheme that is used may comply with standard protocols. For example, device 10 may use multisector antenna 22 and circuitry 12 and 14 in implementing IEEE 802.11 protocols such as the IEEE 802.11n multiple-input multiple-output (MIMO) protocols. Circuitry 12 and 14 may therefore be configured to implement a multiple-input-multiple-output protocol that transmits and receives wireless data using the multiple sectors in multisector antenna 22.

With one suitable multisector arrangement, which is sometimes described herein as an example, antennas such as antenna 22 are formed using parallel plate antenna designs. Each set of parallel plates may form a separate parallel plate antenna sector. These sectors may each have a corresponding antenna feed and may operate as individual antennas. When mounted together in a single antenna arrangement, each individual parallel plate antenna is sometimes referred to herein as forming an independent antenna sector for a multisector antenna. The antenna sectors preferably have substantially different operating characteristics. In particular, each sector preferably has a substantially different directionality to its gain pattern. If desired, some or all of the sectors may also be configured to exhibit different polarization characteristics (e.g., to implement a polarization diversity scheme).

Because the directionality of each antenna sector is different (i.e., each sector points in a different direction), the antenna sectors each pick up a different wireless signals and noise patterns. In accordance with the MIMO protocol implemented on device 10 (e.g., the IEEE 802.11n protocol), the signals from the antenna sectors can be processed together to support improved wireless link performance.

Figure 2:
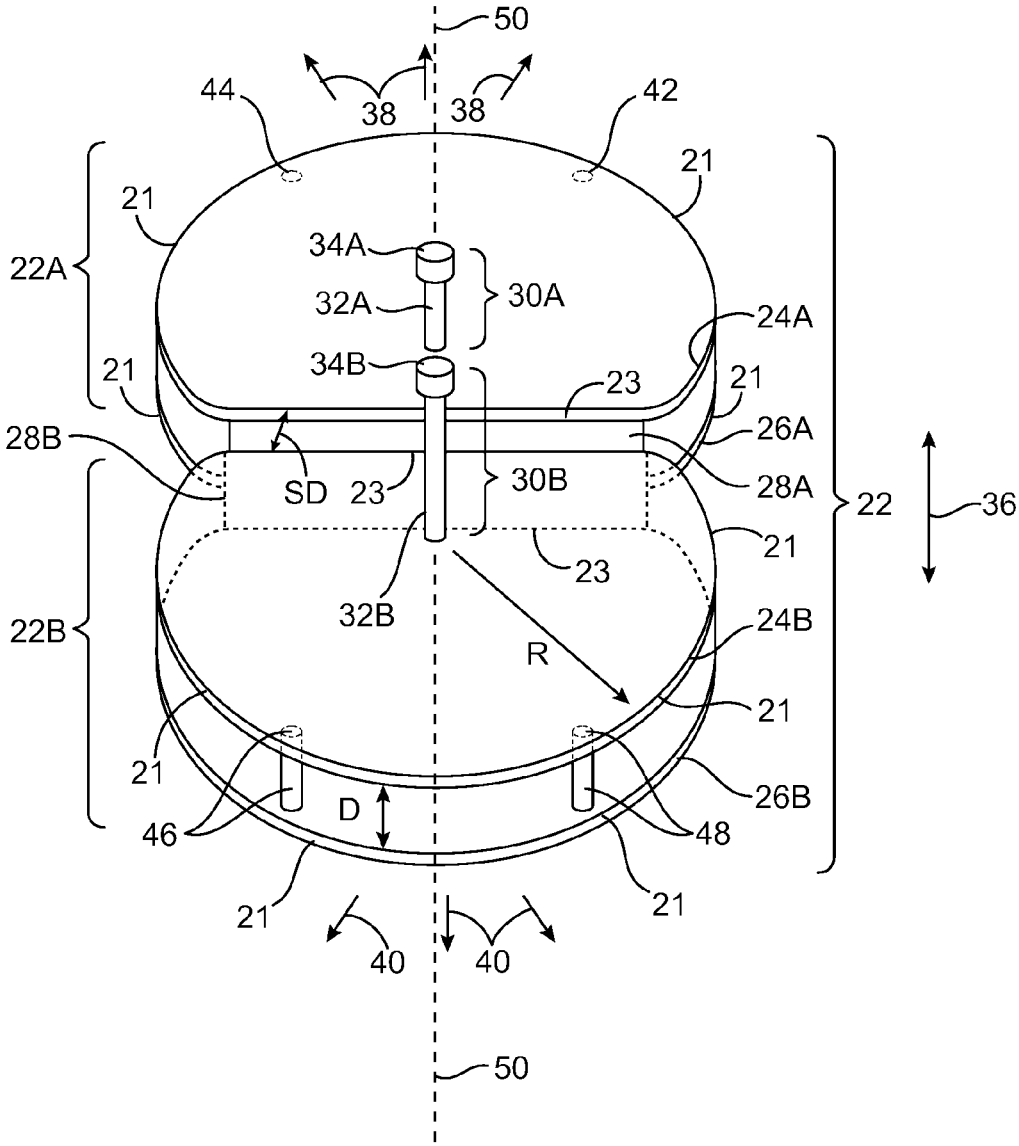
FIG. 2 is a perspective view of an illustrative two sector antenna in accordance with an embodiment of the present invention.

An illustrative parallel plate antenna 22 with two sectors (sectors 22A and 22B) is shown in FIG. 2. Antenna sector 22A has an upper plate 24A and a lower plate 26A, and rear wall 28A. Plates 24A and 24B and wall 28A may be formed from conductive structures such as metal. Rear wall 28A extends vertically parallel to vertical dimension 36. As shown in FIG. 2, the parallel plates in each of the sectors of antenna 22 may have curved outer edges 21 and straight edges 23.

Antenna sector 22A may be fed using an antenna probe. The probe may be, for example, a top-loaded monopole probe. Other probe configurations may be used if desired. In operation, the probe excites radio-frequency signals in parallel plate antenna sector 22A and thereby serves as an antenna feed for antenna sector 22A. The probe may be coupled to a transmission line such as transmission line 20 (FIG. 1) using feed path 30A. Feed path 30A may contain a transmission line path 32A having a ground conductor coupled to ground (e.g., upper plate 24A) and having a positive signal conductor coupled to a conductive disk or other planar loading structure associated with the monopole feed (not visible in the perspective view of FIG. 2). The positive signal conductor may be, for example, a center conductor that passes through an opening in upper plate 24A without electrically contacting upper plate 24A. A connector such as coaxial cable connector 34A may be used to facilitate electrical coupling of transmission line path 32A to a coaxial cable or other transmission line such as transmission line 20 of FIG. 1. The transmission line that is connected to path 32A by connector 34A may, in turn, be connected to radio-frequency transceiver circuitry 18 (FIG. 1).

Antenna sector 22A may have a gain pattern that is directed in the general direction of arrows 38. Antenna sector 22B, in contrast, may operate primarily in directions 40. The gain pattern of each sector may be substantially hemispherical in shape, thereby ensuring complete coverage in all possible signal transmission and reception directions. As shown in FIG. 2, antenna sector 22B, like sector 22A, may have two parallel plates (upper plate 24B and lower plate 26B), and rear wall 28B. Feed path 30B may include feed path transmission line portion 32B and connector 34B.

Upper plate 24B in antenna sector 22B may be separated from lower plate 26B by a vertical distance D (sometimes referred to as the parallel plate height or thickness of antenna sector 22B). Upper plate 24A and lower plate 26A of antenna sector 22A may also be separated by a vertical distance (e.g., vertical distance D). Distance D may be, for example, a quarter of a wavelength at the operating frequency of interest. The rear walls 28A and 28B of antenna sectors 22A and 22B may be separated by a horizontal distance SD (as shown in FIG. 2) or may be formed from a common conductive member. Curved plate edges 21 may be spaced at a radial distance R from feeds 30A and 30B. Radius R may be, for example, three quarters of a wavelength at the operating frequency of interest for antenna 22. Feeds 30A and 30B may be spaced apart from their respective rear walls 28*a* and 28B by a distance equal to about a quarter of a wavelength (as an example). The antenna feeds in antenna 20 may be tuned to resonate at a desired frequency of interest (e.g., 2.45 GHz). Resonance effects may allow antenna 22 to operate in multiple bands (e.g., at both 2.45 GHz and 5.5 GHz).

Interplate structures such as posts 42, 44, 46, and 48 may be connected between the parallel plates in each sector and may used to provide structural support for the parallel plates in antenna 22. Structures such as posts 42, 44, 46, and 48 may be formed from materials such as low-loss dielectrics. When these structures are formed from dielectrics that have dielectric constants different from the air or other surrounding interplate dielectric (such as dielectric 41, shown in FIG. 3), the locations of the posts or other such structures within the gap between opposing plates tends to affect antenna performance. To break the symmetry of antenna 22 with respect to bisecting axis 50 and thereby improve diversity performance in environments in which antenna 22 is arranged with axis 50 parallel to a conductive plane that creates reflections, the positions of posts 42, 44, 46, and 48 can be arranged to break the symmetry of antenna 22 with respect to axis 50. For example, support posts 42 and 44 can be arranged in sector 22A using a different pattern than is used in locating support posts 46 and 48 within antenna sector 22B.

Figure 3:
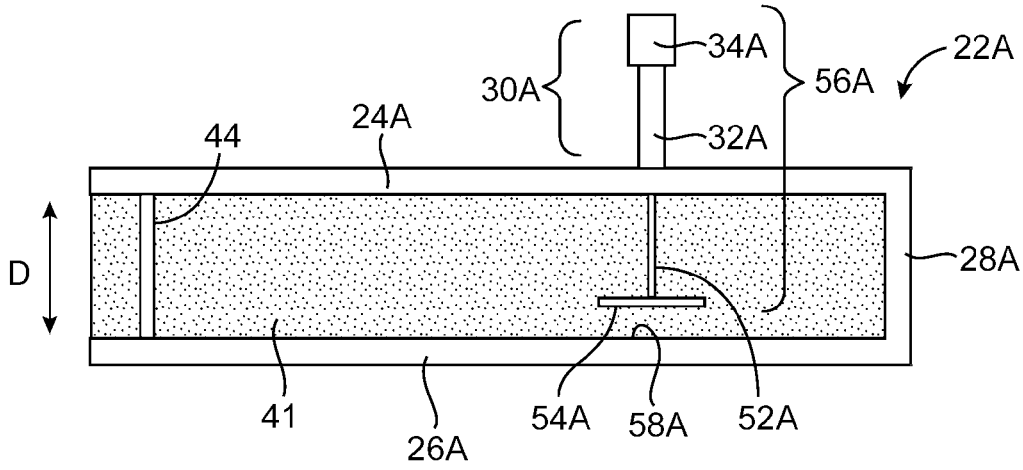
FIG. 3 is a side view of one of the two antenna sectors in the antenna of FIG. 2 in accordance with an embodiment of the present invention.

FIG. 3 is a cross-sectional side view of antenna sector 22A. As shown in FIG. 3, antenna probe 56A may have a conductive member such as member 52A that forms a positive antenna feed line. The top end of path 52A (i.e., the bottom of path 52A in the orientation of FIG. 3) may be loaded with a planar conductive patch such as conductive patch 54A to improve the bandwidth of antenna sector 22A. Patch 54A may be a substantially planar conductive structure such as a sheet of metal and may be arranged so that patch 54A is parallel to planer inner surface 58A of lower plate 36A and corresponding planer upper plate 24A. Loading patch 54A of probe 56A may be coupled to the center connector in path 32A via path 52A (i.e., so that patch 54A is coupled to the center conductor of the coaxial path connected to connector 34A). The shape of patch 54A may be circular, oval, square, etc.

Figure 4:
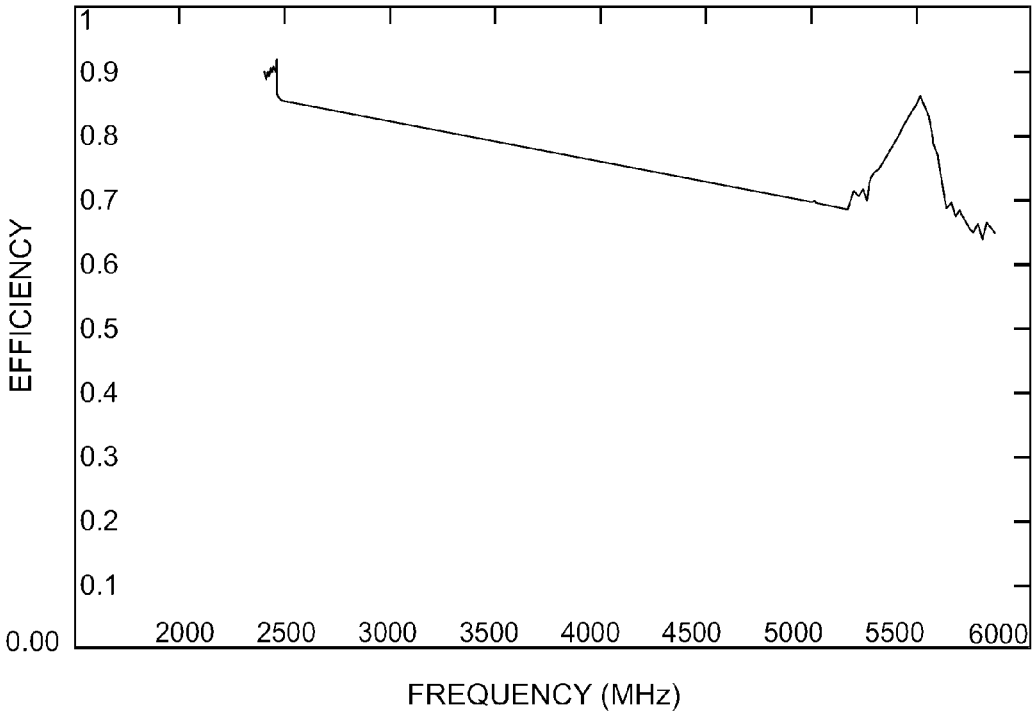
FIG. 4 is a graph of measured antenna efficiency as a function of operating frequency for a dual sector parallel plate antenna in accordance with an embodiment of the present invention.

A graph showing measured antenna efficiency for an antenna such as antenna 44 of FIG. 2 as a function of operating frequency is shown in FIG. 4. As shown in FIG. 4, parallel plate antennas that are fed with top-loaded monopole probes such as antenna probe 56A may exhibit a satisfactory frequency response over signal frequencies of interest for 2.4 GHz and 5 GHz IEEE 802.11 operations (as an example). The 5 GHz band may be covered by a resonance of the 2.4 GHz band. If desired, multisector parallel plate antennas such as antenna 22 of FIG. 2 may be used in other frequency ranges. The use of a parallel plate antenna to cover the wireless local area network bands of 2.4 GHz and 5 GHz in the measurements of FIG. 4 is merely illustrative.

Figure 5:
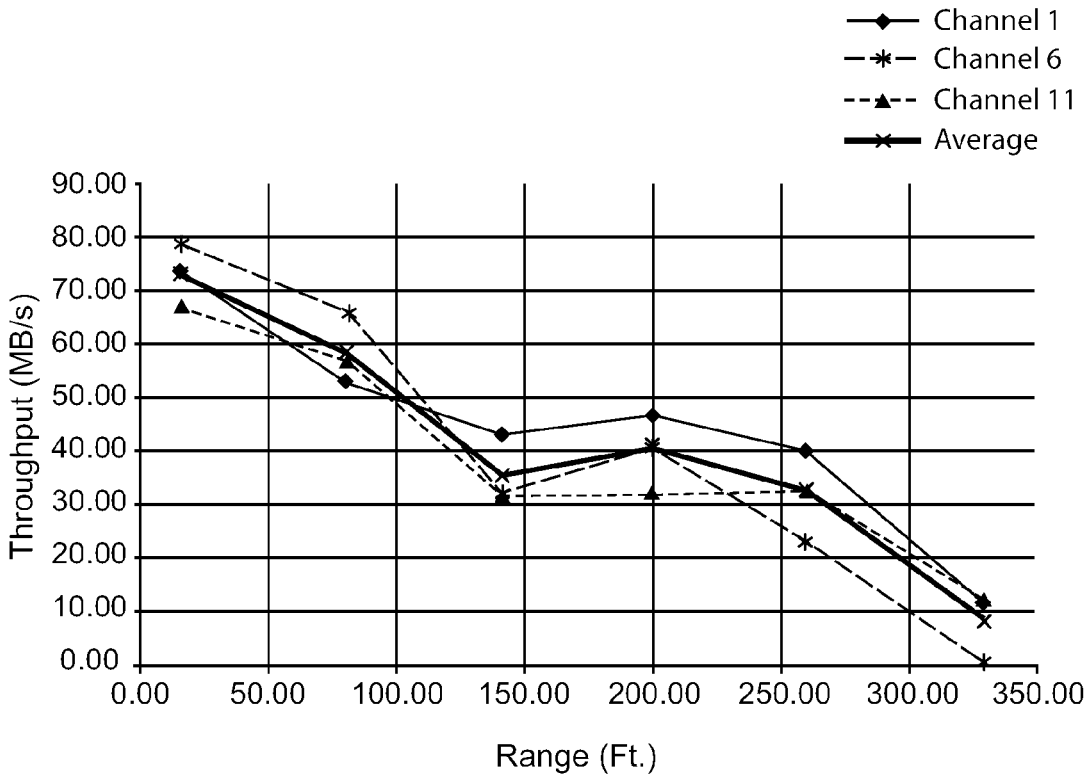
FIG. 5 is a graph of measured antenna throughput as a function of operating range at an operating frequency of 2.45 GHz for a dual sector parallel plate antenna in accordance with an embodiment of the present invention.
Figure 6:
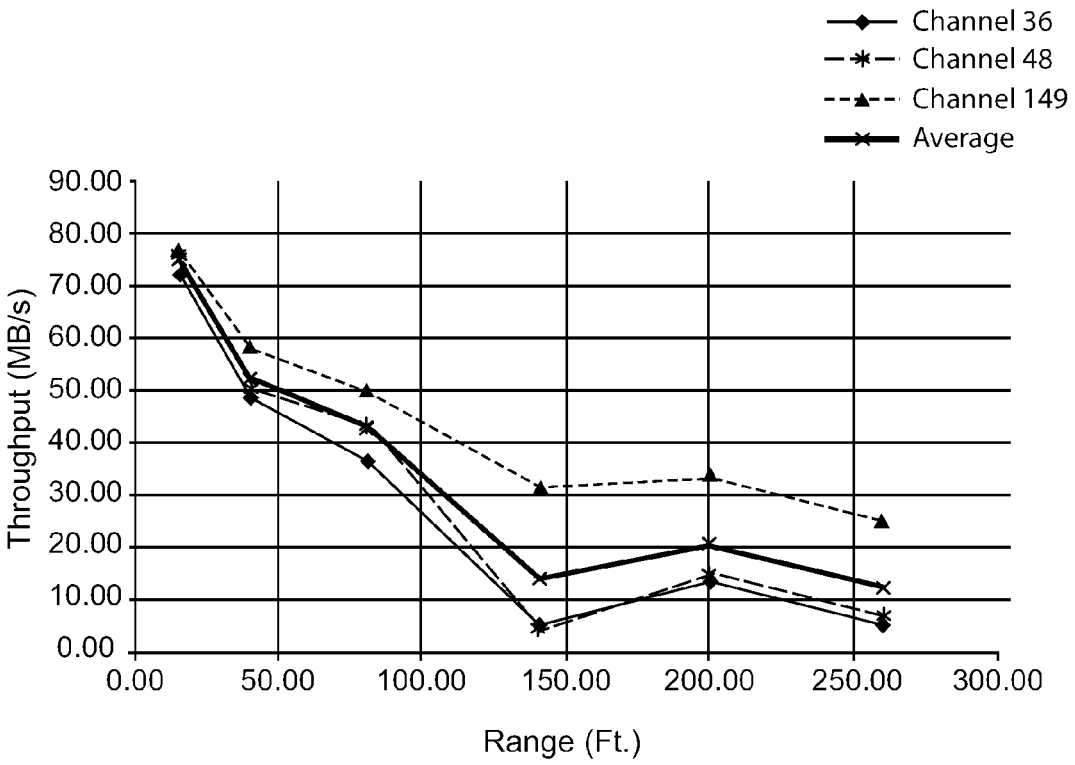
FIG. 6 is a graph of measured antenna throughput as a function of operating range at an operating frequency of 5.5 GHz for a dual sector parallel plate antenna in accordance with an embodiment of the present invention.

Additional performance graphs for a parallel plate antenna such as antenna 22 of FIG. 2 are shown in FIGS. 5 and 6.

In the graph of FIG. 5, measured antenna throughput is plotted versus operating range for several channels in the 2.4 GHz communications band. Average throughput in the 2.4 GHz band is also plotted.

In the graph of FIG. 6, antenna throughput is plotted versus operating range for several channels in the 5 GHz communications band. The graph of FIG. 6 also includes a trace corresponding to average measured throughput in the 5 GHz band for various operating range values.

Figure 7:
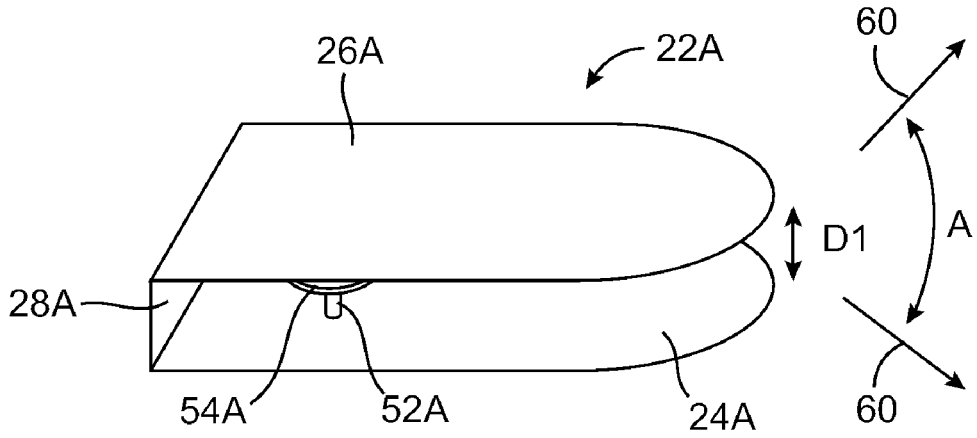
FIG. 7 is a perspective view of a parallel plate antenna structure with a relatively narrow plate separation in accordance with an embodiment of the present invention.
Figure 8:
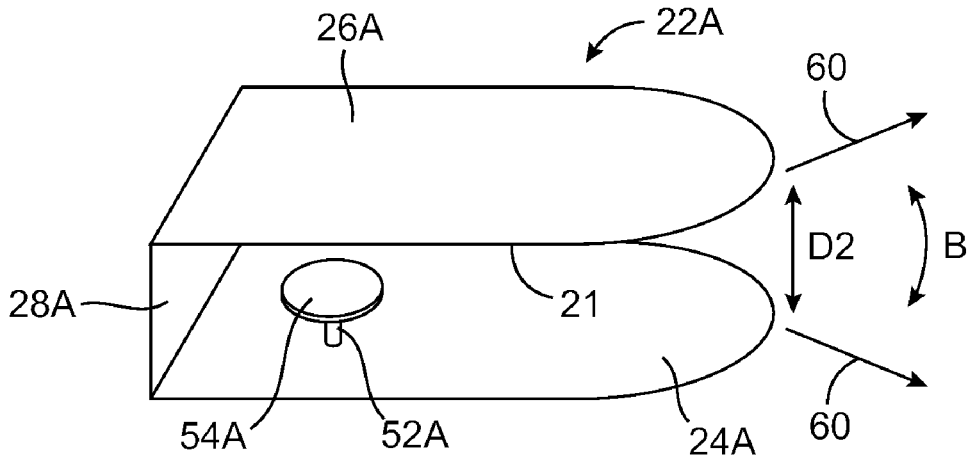
FIG. 8 is a perspective view of a parallel plate antenna structure with a relatively wide plate separation in accordance with an embodiment of the present invention.

The plate separation in a parallel plate antenna can be adjusted to tailor the spatial distribution of the gain pattern for the antenna. The effect of adjustments to the magnitude of the plate separation in antenna sector 22A are illustrated in FIGS. 7 and 8. In the example of FIG. 7, the plate-to-plate spacing between plates 24A and 26A is equal to a relatively small thickness D1. In the example of FIG. 8, in contrast, the plate-to-plate spacing is equal to a relatively large thickness D2. Because the spacing D1 is small in the FIG. 7 example, the radiation pattern for antenna 22A of FIG. 7 is relatively wide, as indicated schematically by the relatively large angle A that is associated with beam 60. In the configuration of FIG. 8, separation D2 is greater than separation D1 of FIG. 7, so beam 60 is characterized by a narrower beam 60 (i.e., a beam having an angle B that is less than angle A of FIG. 7).

If the plate separation in antenna sector 22A is made small enough and if the plate separation in antenna sector 22B is made small enough, the angle of beam 60 in each sector will be large (e.g., near 180°). In this situation, a dual-sector antenna that is formed from antenna sectors 22A and 22B will be able to collectively cover all possible directions of radiation. Sector 22A will cover a first half of the possible directions (i.e., a first hemisphere) and sector 22B will cover the second half of the possible directions (i.e., a second hemisphere that complements the first hemisphere without excessive overlap).

Figure 9:
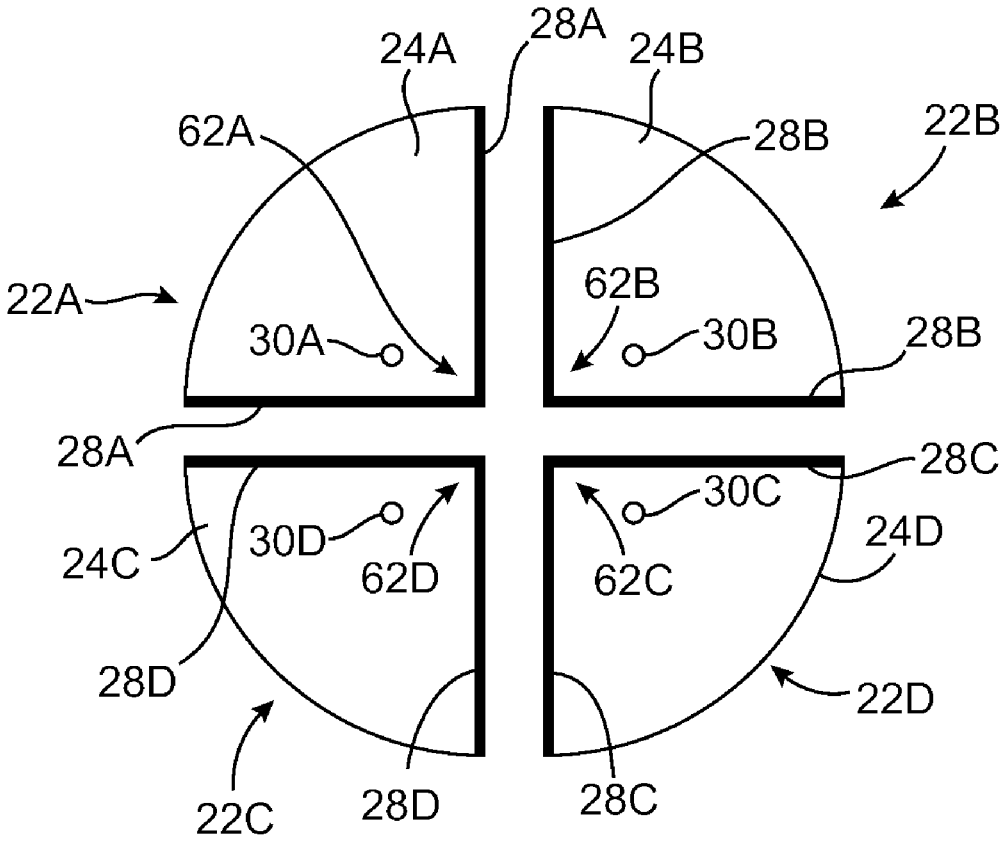
FIG. 9 is a top view of a four-sector parallel plate antenna in accordance with an embodiment of the present invention.

If desired, antenna 22 may have more than two antenna sectors. An illustrative parallel plate antenna 22 having four parallel plate antenna sectors 22A, 22B, 22C, and 22D is shown in FIG. 9. Each antenna sector in the arrangement of FIG. 9 has a top plate, a bottom plate, and a vertical rear wall. Each rear wall is connected to the top and bottom plates along the straight rear edges of the plates and has a bend. For example, antenna sector 22A has top plate 24A, a corresponding bottom plate (not shown in FIG. 9), and a rear wall 28A having 90° bend 62A. Similarly, antenna sector 22B has top plate 24B, a corresponding bottom plate, and rear wall 28B with 90° bend 62B, antenna sector 22C has top plate 24C, a corresponding bottom plate, and rear wall 28C with 90° bend 62C, and antenna sector 22D has top plate 24D, a corresponding bottom plate, and rear wall 28D with 90° bend 62D. Rear walls 62A, 62B, 62C, and 62D may, if desired, be formed from opposing sides of one or more shared vertical planar conductive members. Antenna feeds such as feeds 30A, 30B, 30C, and 30D (each corresponding to a separate antenna probe structure such as probe 56A of FIG. 3) may be used to couple transmission lines 20 (FIG. 1) to each of the antenna sectors from radio-frequency transceiver circuitry 18. In a four-sector antenna of the type shown in FIG. 9, each sector may have a gain pattern shape of a quarter of a sphere (i.e., a gain distribution covering 90° azimuthally around the Z axis and 180° elevationally).

Figure 10:
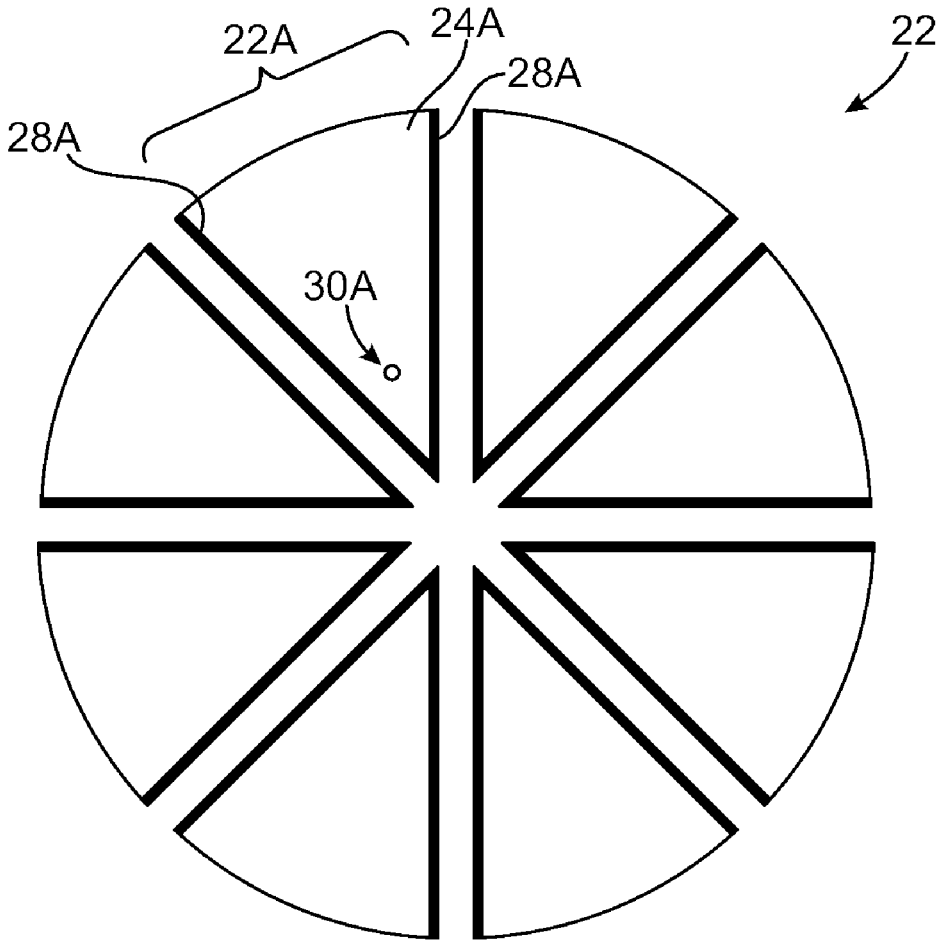
FIG. 10 is a top view of an eight sector parallel plate antenna in accordance with an embodiment of the present invention.
Figure 11:
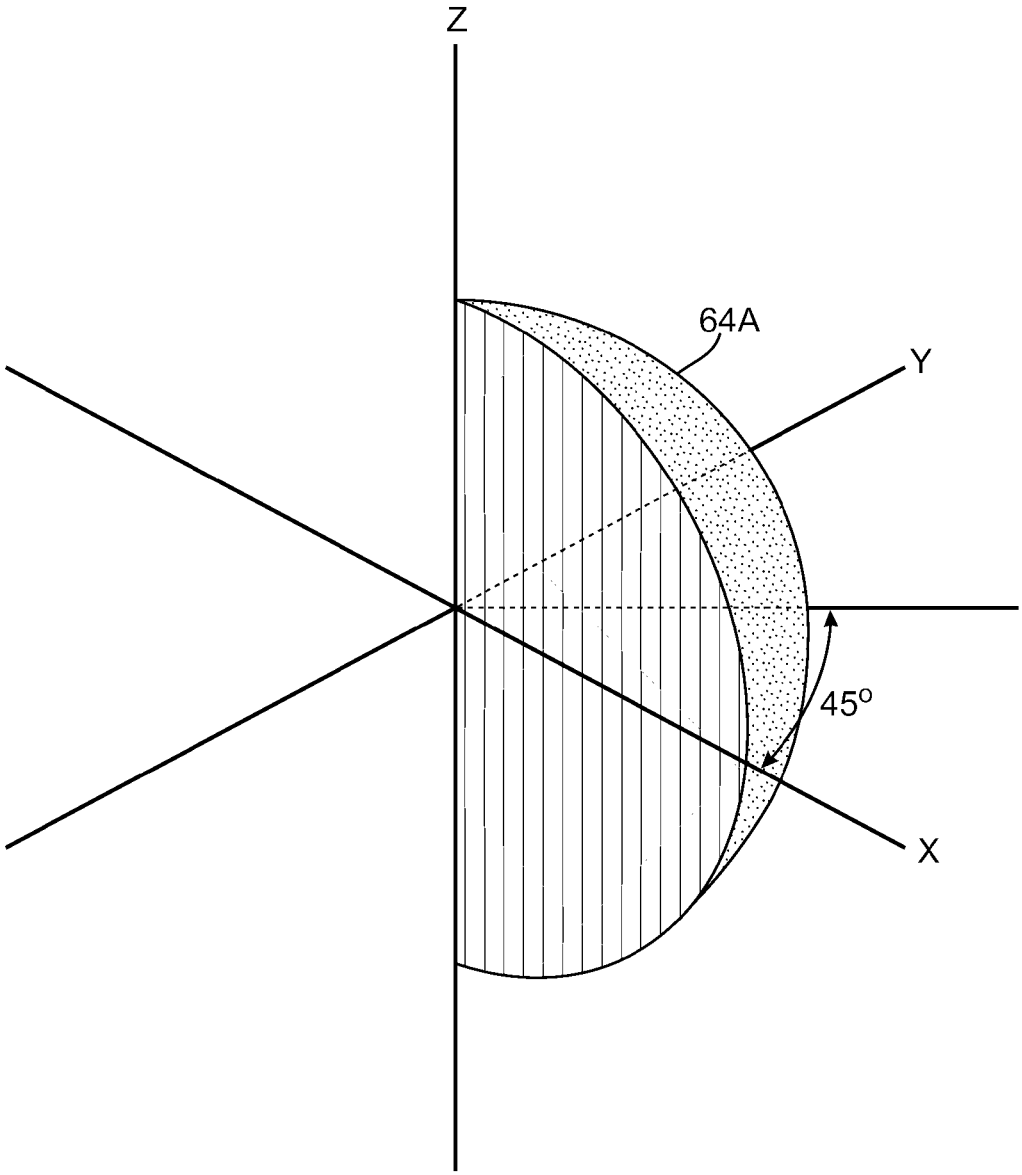
FIG. 11 is a graph showing how an antenna sector in the eight sector parallel plate antenna of the type shown in FIG. 10 may exhibit a radiation pattern associated with a one-eighth section of a sphere in accordance with an embodiment of the present invention.

Antenna 22 may also be formed using other numbers of sectors. For example, parallel plate antenna 22 may be formed from eight sectors, as shown in FIG. 10. In antenna 22 of FIG. 10, each sector such as sector 22A may have a top plate such as plate 24A, a corresponding lower plate, an angled planar vertical rear wall such as rear wall 28A, and an antenna feed such as feed 30A. There are eight sectors in antenna 22 of FIG. 10, each of which may have a radiation pattern of the general shape shown by pattern 64A of FIG. 11 (i.e., one eighth of a sphere). When viewed from the Z direction, each of the eight sectors in the eight-sector antenna of FIG. 10 will have an associated gain pattern that is directed outward over approximately one eighth of a 360° circle (i.e., over 45° azimuthally). As shown in FIG. 11, this one-eighth of a sphere gain pattern may cover 180° in elevation (i.e., completely from the +Z axis to the −Z axis).

A four-sector antenna will have a gain pattern where each antenna sector covers 90° in the X-Y plane. When viewed along the Z-axis, each antenna sector in a dual-sector parallel plate antenna may have a radiation gain pattern such as the gain pattern illustrated by dashed line 66 of FIG. 12 that covers approximately 180° in the X-Y plane (i.e., 180° azimuthally) and that covers 180° elevationally. Antennas with other numbers of parallel plate sectors will have correspondingly proportioned radiation patterns.

Figure 12:
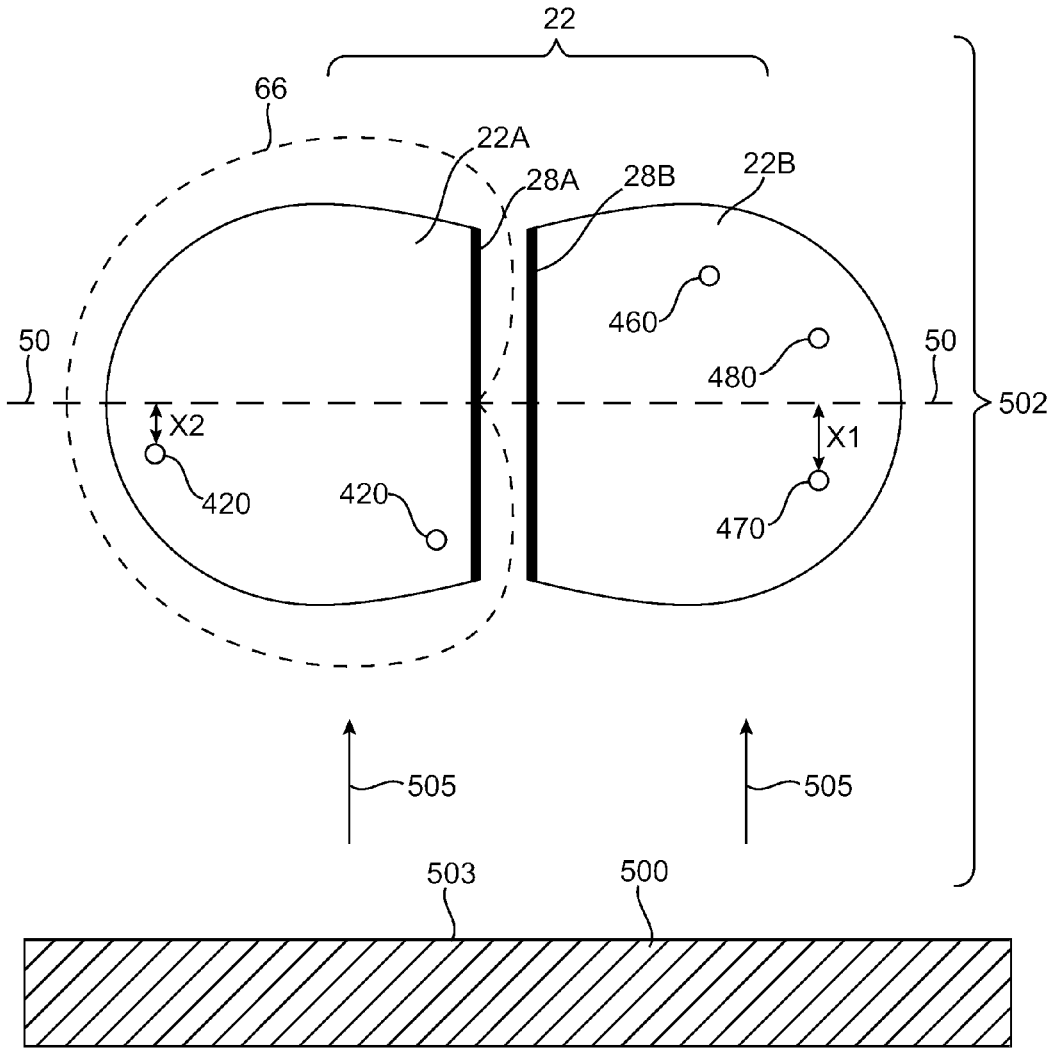
FIG. 12 is a top view of a two-sector parallel plate antenna showing gain as a function of direction and showing illustrative locations for plate support posts in accordance with an embodiment of the present invention.

In some situations, antenna 22 may operate near a conductive surface. The conductive surface can give rise to reflections that serve as a source of interference and reduce the amount of independence that is being sought by using individual antenna sectors. An illustrative system environment that contains a conductive planar surface is shown in FIG. 12. As illustrated in FIG. 12, system 502 may have an antenna 22 that operates in the vicinity of conductive object 500. Conductor 500 may have a substantially planar face 503 that is perpendicular to the page in the orientation of FIG. 12.

Due to reflections from surface 503, antenna sectors 22A and 22B may tend to receive identical signals along paths 505. To reduce the amount of symmetry exhibited by sectors 22A and 22B with respect to bisecting axis 50 and thereby enhance the difference between sectors 22A and 22B in the way in which they respond to the reflected signals along paths 505, sectors 22A and 22B may be provided with symmetry-disrupting structures such as support posts 420, 460, 480, and 470. These posts may be oriented at different lateral spacings from axis 50 in each sector or may otherwise be arranged so that the support structure pattern of one sector differs from the other. As an example, sector 22B may be provided with more posts in the upper half of the antenna than sector 22A (i.e., sector 22B may have two posts such as posts 460 and 480 that lie above axis 50 in the orientation of FIG. 12, whereas sector 22A may have no posts above axis 50). As another example, lateral spacing X2 of post 420 of sector 22A may, if desired, be different than lateral spacing X1 of post 470 in sector 22B. Symmetry may, in general, be reduced using any suitable interplate structures that change the radio-frequency properties of each sector with respect to the other, without preventing the sectors from collectively creating a gain pattern that covers all antenna directions of interest.

The foregoing is merely illustrative of the principles of this invention and various modifications can be made by those skilled in the art without departing from the scope and spirit of the invention.

What is claimed is:

1. A multisector parallel plate electronic device antenna, comprising:

a plurality of parallel plate antenna sectors, each parallel plate antenna sector having a conductive upper plate, a conductive lower plate that is parallel to the upper plate, and a conductive rear wall structure that joins the upper and lower plates;

support posts that are connected between the upper and lower parallel plates in at least one of the parallel plate antenna sectors; and interplate dielectric that surrounds the support posts, wherein the support posts comprise support posts in each of the parallel plate antenna sectors and wherein the support posts in each parallel plate antenna sector have a different pattern.

2. The multisector parallel plate electronic device antenna defined in claim 1, wherein each of the plurality of parallel plate antenna sectors comprises a respective antenna feed.

3. The multisector parallel plate electronic device antenna defined in claim 2 wherein each of the antenna feeds comprises a monopole antenna probe.

4. The multisector parallel plate electronic device antenna defined in claim 2 wherein each of the antenna feeds comprises a monopole antenna probe having a loading patch, wherein the loading patch of each monopole antenna probe is located between the upper and lower plates of a respective one of the parallel plate antenna sectors.

5. The multisector parallel plate electronic device antenna defined in claim 4 wherein each loading patch comprises a loading disk.

6. The multisector parallel plate electronic device antenna defined in claim 5 wherein the loading disk in each parallel plate antenna sectors comprises a planar surface that is parallel to the upper and lower plates in that parallel plate antenna sector.

7. The multisector parallel plate electronic device antenna defined in claim 4 wherein the loading patch in the monopole antenna probe of each parallel plate antenna sectors comprises a planar surface that is parallel to the upper and lower plates in that parallel plate antenna sector.

8. The multisector parallel plate electronic device antenna defined in claim 1 wherein the multisector parallel plate electronic device antenna comprises a dual sector antenna in which the plurality of parallel plate antenna sectors comprises first and second parallel plate antenna sectors whose respective conductive rear wall structures are parallel to each other and wherein the conductive upper and lower plates comprise curved outer edges.

9. The multisector parallel plate electronic device antenna defined in claim 1 wherein the multisector parallel plate electronic device antenna comprises a four sector antenna in which the plurality of parallel plate antenna sectors comprises first, second, third, and fourth parallel plate antenna sectors and wherein the conductive upper and lower plates comprise curved outer edges.

10. The multisector parallel plate electronic device antenna defined in claim 1 wherein the multisector parallel plate electronic device antenna comprises an eight sector antenna and wherein the conductive upper and lower plates comprise curved outer edges.

11. An electronic device, comprising:

storage and processing circuitry that handles data signals for the electronic device;

wireless communications circuitry that transmits and receives the data signals, wherein the wireless communications circuitry comprises a multisector parallel plate antenna that has a plurality of parallel plate antenna sectors and wherein each parallel plate antenna sector has conductive first and second parallel plates; and dielectric support posts between the first and second parallel plates of each of the parallel plate antenna sectors and wherein the dielectric support posts in each parallel plate antenna sector have a different pattern.

12. The electronic device defined in claim 11 wherein the storage and processing circuitry and wireless communications circuitry are configured to implement a multiple-input-multiple-output communications protocol in which data signals are transmitted and received with the plurality of parallel plate antenna sectors.

13. The electronic device defined in claim 12 wherein the first and second parallel plates in each parallel plate antenna sector comprise at least one straight edge and wherein each of the parallel plate antenna sectors comprises a planar conductive rear wall structure connected between the first and second parallel plates along the straight edge of that parallel plate antenna sector.

14. The electronic device defined in claim 13 further comprising an antenna probe in each parallel plate antenna sector, wherein the antenna probe comprises a monopole with a planar loading patch, wherein the loading patch of each antenna probe is parallel to the first and second parallel plates of the parallel plate antenna sector containing that antenna probe.

15. The electronic device defined in claim 12 further comprising:

switching circuitry that is coupled to each of the parallel plate antenna sectors.

16. An electronic device, comprising:

storage and processing circuitry that handles data signals for the electronic device; and wireless communications circuitry that transmits and receives the data signals, wherein the wireless communications circuitry comprises a multisector parallel plate antenna, wherein the multisector parallel plate antenna comprises a plurality of parallel plate antenna sectors, and wherein each parallel plate antenna sector has:

a conductive upper plate having a curved outer edge and at least one straight edge;

a conductive lower plate having a curved outer edge and at least one straight edge;

a conductive planer rear wall that joins the conductive upper plate to the conductive lower plate along the straight edges of the conductive upper and lower plates; and dielectric posts that are coupled between the conductive upper plate and the conductive lower plate, wherein the dielectric posts in a first one of the parallel plate antenna sectors are disposed in a first pattern relative to the first one of the parallel plate antenna sectors, wherein the dielectric posts in a second one of the parallel plate antenna sectors are disposed in a second pattern relative to the second one of the parallel plate antenna sectors, and wherein the first and second patterns are different.

17. The electronic device defined in claim 16 further comprising:

transceiver circuitry in the wireless communications circuitry; and an antenna probe in each parallel plate antenna sector, wherein each antenna probe has a conductive member that is coupled to a transmission line center conductor that is coupled to the transceiver circuitry, wherein the conductive member in each antenna probe has an end, and wherein each antenna probe has a planar loading disk connected to the end of the conductive member of that antenna probe.

18. A multisector parallel plate electronic device antenna, comprising:

a plurality of parallel plate antenna sectors, each parallel plate antenna sector having a conductive upper plate, a conductive lower plate that is parallel to the upper plate, and a conductive rear wall structure that joins the upper and lower plates;

support posts that are connected between the upper and lower parallel plates in at least one of the parallel plate antenna sectors; and interplate dielectric that surrounds the support posts, wherein the interpolate dielectric has a first dielectric constant and wherein at least one of the support posts has a second dielectric constant that is different from the first dielectric constant.

* * * * *